US010438537B2

(12) United States Patent
Chen et al.

(10) Patent No.: US 10,438,537 B2
(45) **Date of Patent: *Oct. 8, 2019**

(54) PIXEL DRIVING CIRCUIT AND DISPLAY APPARATUS THEREOF

(71) Applicant: HON HAI PRECISION INDUSTRY CO., LTD., New Taipei (TW)

(72) Inventors: Po-Fu Chen, New Taipei (TW); Kuo-Sheng Lee, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 15/920,475

(22) Filed: Mar. 14, 2018

(65) Prior Publication Data

US 2018/0268757 A1 Sep. 20, 2018

Related U.S. Application Data

(60) Provisional application No. 62/471,234, filed on Mar. 14, 2017.

(51) Int. Cl.

| | |
|---|---|
| ***G09G 3/32*** | (2016.01) |
| ***G09G 3/3258*** | (2016.01) |
| ***G09G 3/3266*** | (2016.01) |
| ***G09G 3/3233*** | (2016.01) |

(52) U.S. Cl.

CPC ..... *G09G 3/3258* (2013.01); *G09G 3/3233* (2013.01); *G09G 3/3266* (2013.01); *G09G 2300/0819* (2013.01); *G09G 2300/0861* (2013.01); *G09G 2310/0251* (2013.01)

(58) Field of Classification Search

CPC ... G09G 3/32–3291; G09G 2300/0439; G09G 2300/0809; G09G 2300/0819; G09G 2300/0861; G09G 2300/0895; G09G 2310/0251

See application file for complete search history.

(56) References Cited

U.S. PATENT DOCUMENTS

| | | | | |
|---|---|---|---|---|
| 2010/0053041 | A1* | 3/2010 | Abe | G09G 3/325 345/76 |
| 2011/0316892 | A1* | 12/2011 | Sung | G09G 3/3233 345/690 |
| 2014/0168194 | A1* | 6/2014 | Kong | G09G 3/3233 345/212 |
| 2015/0187276 | A1* | 7/2015 | Shim | G09G 3/3233 345/77 |
| 2016/0042694 | A1 | 2/2016 | Lim et al. | |
| 2016/0125800 | A1* | 5/2016 | Kim | G09G 3/3225 345/212 |

* cited by examiner

*Primary Examiner* — Nathan Danielsen
(74) *Attorney, Agent, or Firm* — ScienBiziP, P.C.

(57) ABSTRACT

A pixel driving circuit for driving a pixel unit comprises a light emitting element, an initial transistor, a drive transistor with a first gate electrode and a second gate electrode, a control transistor, a resetting transistor, a first storage capacitor, and a second storage capacitor. A gate electrode of the second initial transistor receives the second control signal, a source electrode of the second initial transistor is electrically connected to an anode of the light emitting element, and a drain electrode of the second initial transistor is electrically connected to a source electrode of the drive transistor.

8 Claims, 10 Drawing Sheets

PIXEL DRIVING CIRCUIT AND DISPLAY APPARATUS THEREOF

FIELD

The present disclosure relates to a pixel driving circuit and a display apparatus thereof.

BACKGROUND

Display devices, such as liquid crystal display devices and organic electroluminescent (EL) display devices are widely used. These display devices include a plurality of pixel units. Each pixel unit corresponds to a pixel driving circuit. The pixel driving circuit includes a switching transistor, a drive transistor, a resetting transistor, a capacitor, and an organic light emitting diode (OLED). The pixel driving circuit sequentially operates in an initiating period, a compensation and writing period, and an emitting period. During the initiating period, the resetting transistor turns on for resetting the drive transistor and\or the OLED, thus an operation of writing data signals on a data line to the drive transistor is ensure. During the compensation and writing period, the switching transistor turns off based on an active signal on a scan line, such as high level voltage, the data signals on the data line is provided to the drive transistor and charges the capacitor. The drive transistor turns on. During the emitting period, the capacitor discharges, the drive transistor turns on, a current generated by the power source is providing to the OLED, thus the OLED emits light. Due to a variation of a threshold voltage of the drive transistor, a variation of the current provided to the OLED may occur, thus a threshold voltage of the drive transistor needs to be compensated before the emitting period to prevent the current provided to the OLED form being effected by the variation of the threshold voltage. Due to a larger size of the display device with a high frequency driving, a time of the compensation and writing period corresponding to each pixel unit in a display frame becomes less, and the threshold voltage of the drive transistor is not fully compensated. Thus, there is room for improvement in the art.

BRIEF DESCRIPTION OF THE FIGURES

Implementations of the present disclosure will now be described, by way of example only, with reference to the attached figures, wherein.

DETAILED DESCRIPTION

Figure 1:
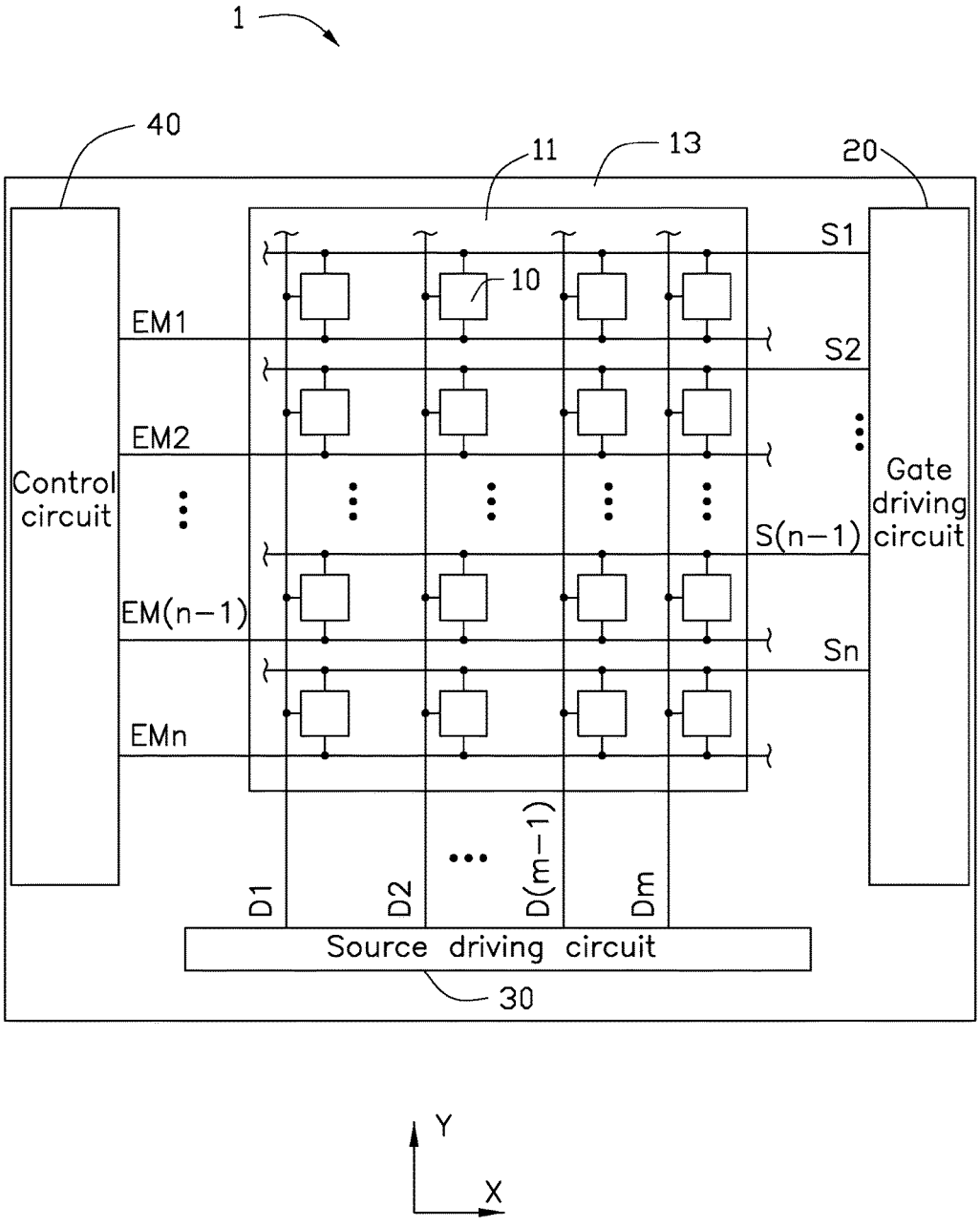
FIG. 1 is a plan view of an embodiment of a display apparatus with a pixel driving circuit.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "comprising" means "including, but not necessarily limited to"; it specifically indicates open-ended inclusion or membership in a so-described combination, group, series, and the like.

The present disclosure is described in relation to a display apparatus with an improved image quality. The display apparatus includes a plurality of scan lines, a plurality of data lines, and a plurality of control lines. The scan lines and the data lines are arranged as a grid to define a plurality of pixel units at the crossed-line portions. Each pixel unit corresponds to one scan line, one data line, and a control line. Each pixel unit further corresponds to a pixel driving circuit. The pixel driving circuit is a current type pixel driving circuit. The pixel driving circuit includes an initial transistor, a drive transistor, a resetting transistor, a control transistor, a first storage capacitor, and a light emitting element. Due to a scan signal on the connected scan line is effective, such as a high level voltage, the initial transistor provides a bias voltage to the drive transistor. Due to a control signal of the connected control line is effective, the control transistor provides a voltage on the connected data line to the drive transistor. Due to the control signal is effective, the resetting transistor resets an anode of the light emitting element. A cathode of the light emitting element is grounded. The pixel driving circuit further includes a second storage capacitor. The drive transistor is a dual gate transistor. The drive transistor includes a first gate electrode and a second gate electrode. The first gate electrode is electrically connected to a source electrode of the initial transistor. The second gate electrode is electrically connected to a source electrode of the control transistor. Two terminals of the first storage capacitor are respectively connected to the first electrode and a source electrode of the drive transistor. Two terminals of the second storage capacitor are respectively connected to the second gate electrode and the source electrode of the drive transistor.

In an embodiment, a threshold voltage of the drive transistor linearly varies in accordance with a voltage of the second gate electrode of the drive transistor.

In an embodiment, the pixel driving circuit sequentially operates under a first frame and subsequent other frames, which are after the first frame. During the first frame, the pixel driving circuit sequentially operates under the initiating period and a compensation period during the first frame. During the initiating period, the drive transistor and the light emitting element are initial. During the compensation period, a first threshold of the drive transistor is stored in the first storage capacitor.

In an embodiment, when the signal of the scan line and the control signal of the control line are effective the pixel driving circuit is in the initiating period. During the initiating period, the initial transistor, the control transistor, the resetting transistor, and the drive transistor turn on. The bias voltage is provided to the first gate electrode, and a first reference voltage on the data line is provided to the second gate electrode. A second reference voltage is provided to the source electrode of the drive transistor for resetting the drive transistor and the anode of the lighting emitting element. When the signal of the scan line is effective, and the control signal is ineffective, such as a low level voltage, the pixel driving circuit is in the compensation period. During the compensation period, the initial transistor and the drive transistor turn on. The control transistor and the resetting transistor turn off. A first threshold voltage of the driving voltage is stored on the first storage capacitor.

In an embodiment, during other frames after the first frame, the pixel driving circuit sequentially operates under a writing period and an emitting period. During the writing period, a data voltage of the data line is provided to the second gate electrode. The second storage capacitor stores a second threshold voltage and the data voltage. During the emitting period, the light emitting element emits light. The data voltage is larger than the first reference voltage.

In an embodiment, when the signal of the scan line is ineffective, the control signal is effective, the pixel driving circuit is in the writing period. During the writing period, the initial transistor turns off. The control transistor, the resetting transistor, and the drive transistor turn on. The data voltage is provided to the second gate electrode. The second storage capacitor stores the second threshold voltage and the data voltage. When the signal on the scan line and the control signal are effective, the pixel driving circuit is in the emitting period. During the emitting period, the initial transistor, the control transistor, and the resetting transistor turn off. The drive transistor turns on for driving the light emitting element based on the data voltage.

In an embodiment, the pixel driving circuit sequentially operates under a blanking frame, a first frame after the blanking frame, and other frames after the first frame. During the blanking frame, the pixel driving circuit resets the source electrode of the drive transistor. During the first frame, the pixel driving circuit sequentially operates under an initiating period and the compensation period. During the initiating period, the first gate electrode is set at a bias voltage, and the first reference voltage is provided by the data line. During the compensation period, the first storage capacitor stores the first threshold voltage. During other frame, the pixel driving circuit sequentially operates under a writing period and an emitting period. During the writing period, the data voltage of the data line is provided to the second gate electrode. The second storage capacitor stores a second threshold voltage and the data voltage. During the emitting period, the light emitting element emits light.

The detail description of the embodiment as below.

Figure 2:
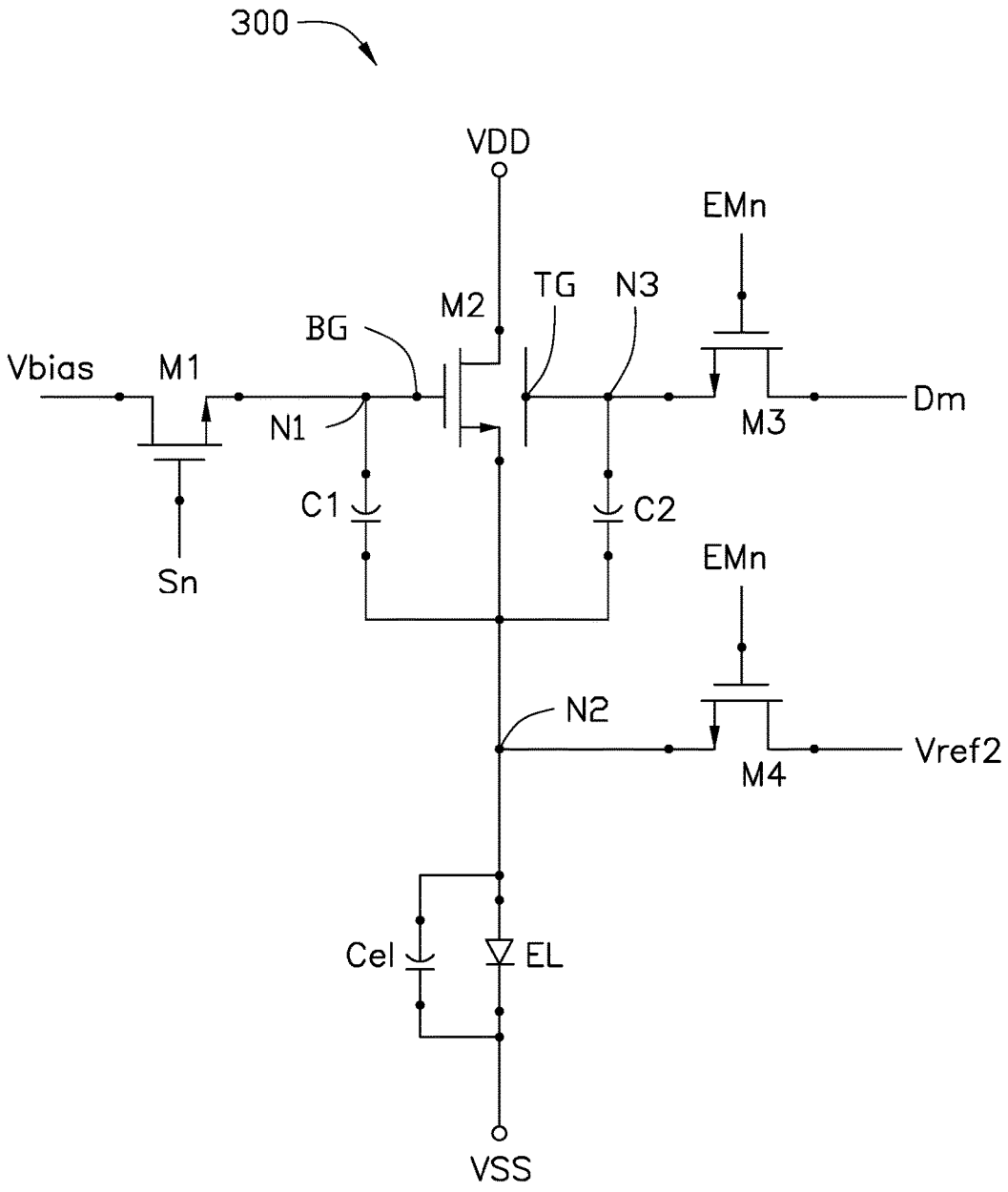
FIG. 2 is a circuit diagram view of an embodiment of the pixel driving circuit of FIG. 1, the pixel driving circuit operates an initiating period, a compensation period, a writing period, and an emitting period.
Figure 4:
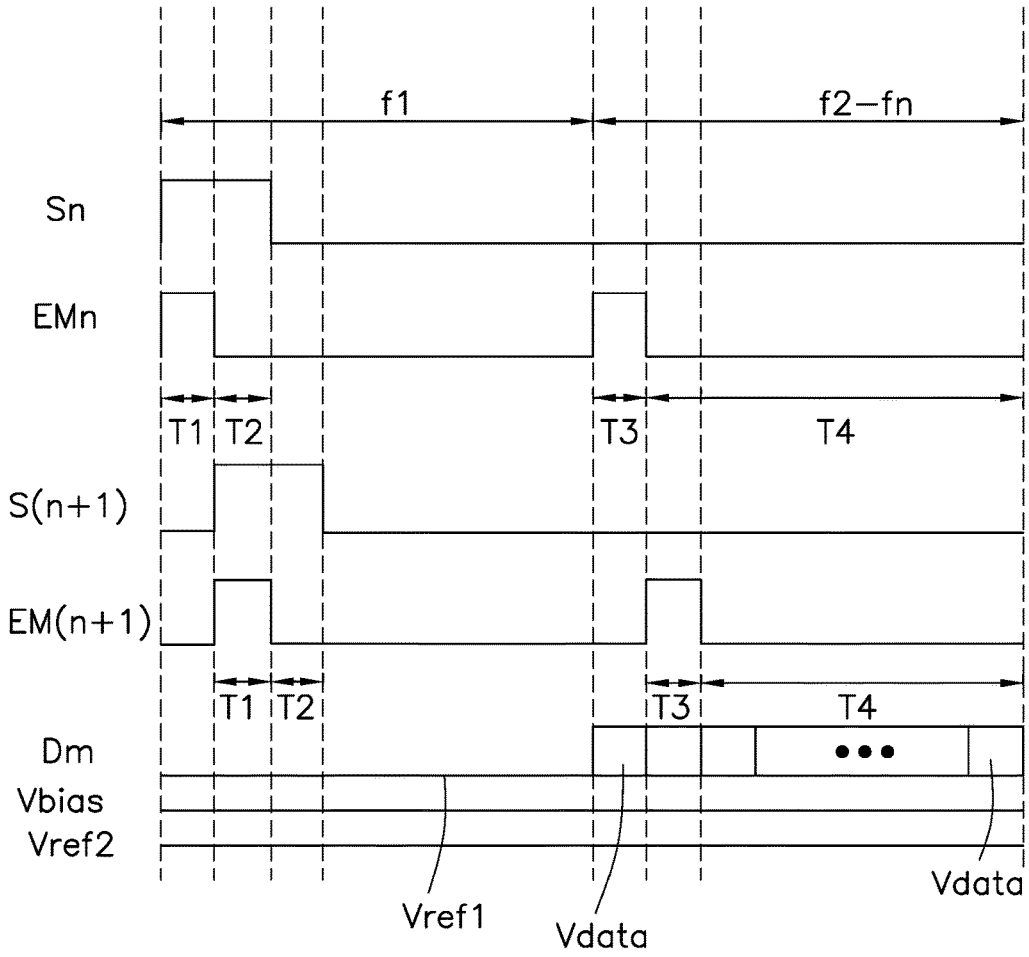
FIG. 4 is a timing chart showing waveforms of a first embodiment of various signals of the pixel units of FIG. 1.

FIG. 1 illustrates an embodiment of a display apparatus 1. In at least one embodiment, the display apparatus 1 is, for example, an organic light emitting diode (OLED) device. The display apparatus 1 defines a display region 11 and a non-display region 13 surrounding the display region 11. The display region 11 a plurality of scan lines S1-Sn, a plurality of data lines D1-Dm, a plurality of control lines EM1-EMn. The scan lines S1-Sn extending along a first direction X and the data lines D1-Dm extending along a second direction Y perpendicular to the first direction X as a grid define a plurality of pixel units 10. In other embodiments, the scan lines S1-Sn, the control lines EM1-EMn, and the data lines D1-Dm can be arranged in an angled manner, but not limited. The display apparatus 1 further includes a gate driving circuit 20, a source driving circuit 30, and a control circuit 40, which are located in the non-display region 103. Each pixel unit 10 is electrically connected to the gate driving circuit 20 through one of the scan lines S1-Sn, is electrically connected to the source driving circuit 30 through one of the data lines D1-Dm, and further electrically connected to the control circuit 40 through two adjacent of the control lines EM1-EMn. In an embodiment, the gate driving circuit 20, the source driving circuit 30, and the control circuit 40 are formed on a chip-on-glass (COG) through a tape-automated bonding manner, or formed on a display panel through a gate-in-panel (GIP) manner. In other embodiment, the gate driving circuit 20, the source driving circuit 30, and the control circuit 40 are embedded on the display panel. The display apparatus 1 further includes a timing controller (not shown) in the non-display region 13. The timing controller supplies various control signals (not shown) to the gate driving circuit 20 for driving the display apparatus to display images, and further supplies data signals to the source driving circuit 30. The various control signals may include a vertical synchronization (Vsync) signal, a horizontal synchronization (Hsync) signal, a clock (CLK) signal, and a data enable (DE) signal, but is not limited thereto. Each pixel unit 10 corresponds to the pixel driving circuit 300 (as shown in FIG. 2). The display apparatus 1 further includes a first frame f1 and a plurality of other subsequent frames f2-fn after the first frame f1 (as shown in FIG. 4).

FIG. 2 illustrates a first embodiment of the driving circuit 300 corresponding to a pixel driving circuit 10. The pixel driving circuit 300 corresponds to the scan line Sn, the data line Dm, and a control line EMn. The pixel driving circuit 300 is a current type pixel driving circuit.

Figure 3:
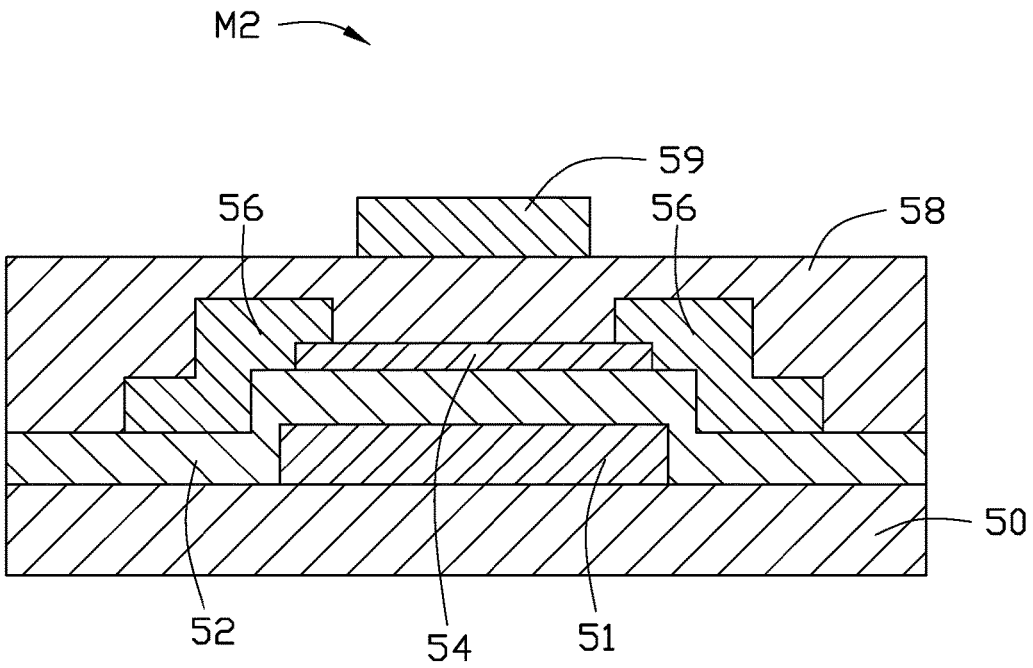
FIG. 3 is a cross-sectional view of the drive transistor of FIG. 2.

The pixel driving circuit 300 includes an initial transistor M1, a drive transistor M2, a control transistor M3, a resetting transistor M4, a first storage capacitor C1, a second storage capacitor C2, and a light emitting element EL. In the embodiment, the initial transistor M1, the drive transistor M2, the control transistor M3, and the resetting transistor M4 are same transistors, such as N-type Metal Oxide Semiconductor (NMOS) transistors. In the pixel driving circuit 300, the drive transistor M2 is a dual gate transistor. The drive transistor M2 includes a first gate electrode BG (as shown in FIG. 3), a second gate electrode TP (as shown in FIG. 3), a channel layer 54 (as shown in FIG. 3), a source electrode (not labeled), and a drain electrode (not labeled). A bottom gate type transistor is formed by the first gate electrode BG the channel layer 54, the source electrode, and the drain electrode. Further, a top gate type transistor is formed by the second gate electrode TP, the channel layer 54, the source electrode, and the drain electrode. A threshold voltage of the drive transistor M2 is linearly varied in accordance with a voltage of a second gate electrode of the drive transistor M2. In the first frame f1, the drive transistor M2 corresponds a first threshold voltage Vth1 due to a first reference Vref1, in the other frames f2-fn, the drive transistor M2 corresponds a second threshold voltage Vth2 due to a data voltage Vdata. The first reference voltage Vref1 is less than the data voltage Vdata. The first threshold voltage Vth1 is a breakover voltage for turning on the drive transistor M2 during the first frame f1, and the second threshold voltage Vth2 is a breakover voltage for turning on the drive transistor M2 during the other subsequent frames f2-fn.

A gate electrode of the initial transistor M1 is electrically connected to the corresponding scan line Sn, a source electrode of the initial transistor M1 receives a bias voltage Vbias from a power line, and a drain electrode of the initial transistor M1 is electrically connected to a first gate electrode BG of the drive transistor M2 through a first node N1. A source electrode of the drive transistor M2 is electrically connected to an anode of the light emitting element EL thorough a second node N2, a drain electrode of the drive transistor M2 receives a power voltage VDD from a power line, a second electrode of the drive transistor M2 is electrically connected to a source electrode of the control transistor M3 through a third node N3. A gate electrode of the control transistor M3 receives the control signal from the control line EMn, a drain electrode of the control transistor M3 is electrically connected to the data line Dm. A gate electrode of the resetting transistor M4 receives the control signal, a drain electrode of the resetting transistor M4 receives a second reference voltage Vref2 as a reset signal, and a source electrode of the resetting transistor M4 is electrically connected between the source electrode of the drive transistor M2 and the anode of the light emitting element EL. In other words, the source electrode of the resetting transistor M4 is electrically connected to the second node N2. A first terminal of the first storage capacitor C1 is electrically connected to the first gate electrode BG of the drive transistor M2 by passing through the second node N2, and a second terminal of the first storage capacitor C1 is electrically connected to the source electrode of the drive transistor M2. A first terminal of the second storage capacitor C2 is electrically connected to the second gate electrode TG of the drive transistor M2 by passing through the third node N3, and a second terminal of the second storing transistor C2 is electrically connected to the source electrode of the drive transistor M2 by passing through the second node N2. A cathode of the light emitting element EL is electrically connected to a ground voltage VSS. A parasitic capacitor Cel is formed, and two terminals of the parasitic capacitor Cel are respectively electrically connected to the anode and the cathode of the light emitting element EL. In the embodiment, the second reference voltage is less than the ground voltage VSS.

FIG. 3 illustrates a cross-sectional of the drive transistor M2. The drive transistor M2 includes a substrate 50, a first conductive layer 51, an insulating layer 52, a channel layer 54, a second conductive layer 56, a passivation layer 58, and a third conductive layer 59. The substrate 50 may be made of a transparent glass or a plastic material. In other embodiments, the substrate 50 may be made of one of Polycarbonate (PC), Polythylene terephthalate (PET), Polymethylmethacrylate (PMMA), Cyclic Olefin Copolymer (COC), or Polyether sulfone (PES). In other embodiments, the substrate 50 can be a flexible substrate. The first conductive layer 51 is disposed on the substrate 50. The first conductive layer 51 is being patterned to form the first gate electrode BG. The insulating layer 52 is covered on a surface of the substrate 50 exposed from the first conductive layer 51 and a surface of the first conductive layer 51 way from the substrate 50. The insulating layer 52 insulates the channel layer 54 from the first conductive layer 51. The insulating layer 52 is capable of the deforming. The insulating layer 52 is made of a flexible material. In other exemplayer embodiment, the insulating layer 52 is a transparent material or a translucent material. The channel layer 54 is disposed on a surface of the insulating layer 52 way from the first conductive layer 51. The channel layer 54 is being patterned to form an semiconductor path of the drive transistor M2. A projector of the channel layer 54 on the first conductive layer 51 is at a center of the first conductive layer 51. The second conductive layer 56 is disposed on the channel layer 54 way from the insulating layer 52 and the insulating layer 52 exposing from the channel layer 54. The second conductive layer 56 covers a surface of the insulating layer 52 way from the first conductive layer 51, a surface of the channel layer 54 way from the insulating layer 52, and further covers a side surface of the channel layer 54. The channel layer 54 is partially exposed from the second conductive layer 56. The second conductive layer 56 is patterned to form a source electrode and a drain electrode of the drive transistor M2. The passivation layer 58 is disposed on the second conductive layer 56 and the channel layer 54. The third conductive layer 59 is disposed on the passivation layer 58 way from the second conductive layer 56. The third conductive layer 59 is being patterned to form the second gate electrode TG. The second gate electrode TG is overlapped with the first gate electrode BG. A projector of the second gate electrode TG is at a center of the first conductive layer 51. In the embodiment, the first conductive layer 51, the second conductive layer 56, and the third electrode layer 59 is made of metal material, but not limited to, such as Ag, Cu, and Mo. In the embodiment, the first gate electrode and the second gate electrode are overlapped along a direction perpendicular to the substrate 50. The voltages of the first gate electrode BG and the second gate electrode TP are related to the threshold voltage of the drive transistor M2.

FIG. 4 illustrates a first embodiment of waveforms of the various signals of the pixel units 10. FIG. 4 only shows the waveforms of the various signals of the pixel units 10 corresponding to the scan lines S(n−1)-Sn. The first frame f1 is an initial frame, and the other frames f2-fn are display frames. In the first frame f1, all the pixel driving circuits 300 corresponding to the pixels 10 sequentially operates under an initiating period T1. After the pixel driving circuit 300 corresponding to the last pixel unit 10 has completed the initial operation, the pixel driving circuits 300 corresponding to the pixel units 10 sequentially operate under a compensation period T2. After the pixel driving circuit 300 corresponding to the last pixel unit 10 is completed the compensation operation, the pixel driving circuits 300 corresponding to the pixel units 10 sequentially operate under an writing period T3. After the pixel driving circuit 300 has completed the writing operation, the pixel driving circuit 300 operates under an emitting period T4.

The pixel units 10 arranged in one line are controlled by a same scan line Sn and a control line EMn, and load different voltages from the data lines D1-Dm, such as a first reference voltage Vref1. The pixel units 10 arranged in one column load a same voltage from the data line Dm, and are controlled by different scan lines S1-Sn and the different control lines EM1-EMn. In the embodiment, the pixel units 10 in adjacent lines are sequentially scanned by the scan lines S1-Sn and the control lines EM1-EMn. The pixel units 10 in adjacent columns are sequentially loaded the voltage of the data lines D1-Dm.

In detail, the driving method of the pixel driving circuit 300 receiving signals of the scan line Sn, the control line EMn, and the data line Dm is described as below as an example.

Figure 5:
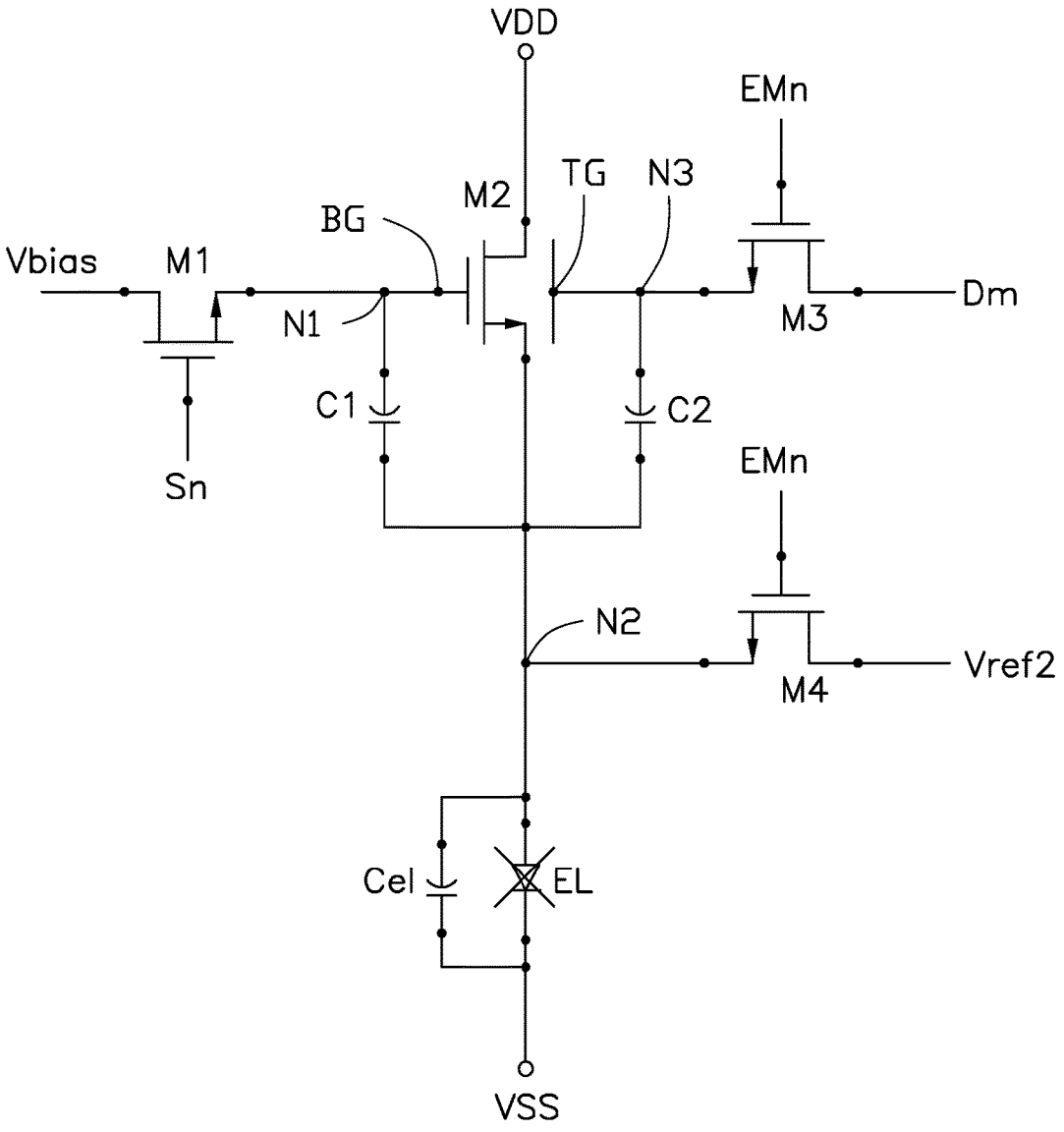
FIG. 5 is a circuit diagram view of the pixel driving circuit of FIG. 2, which operates in the initiating period, and the elements with a "X" mark are turned-off.
Figure 6:
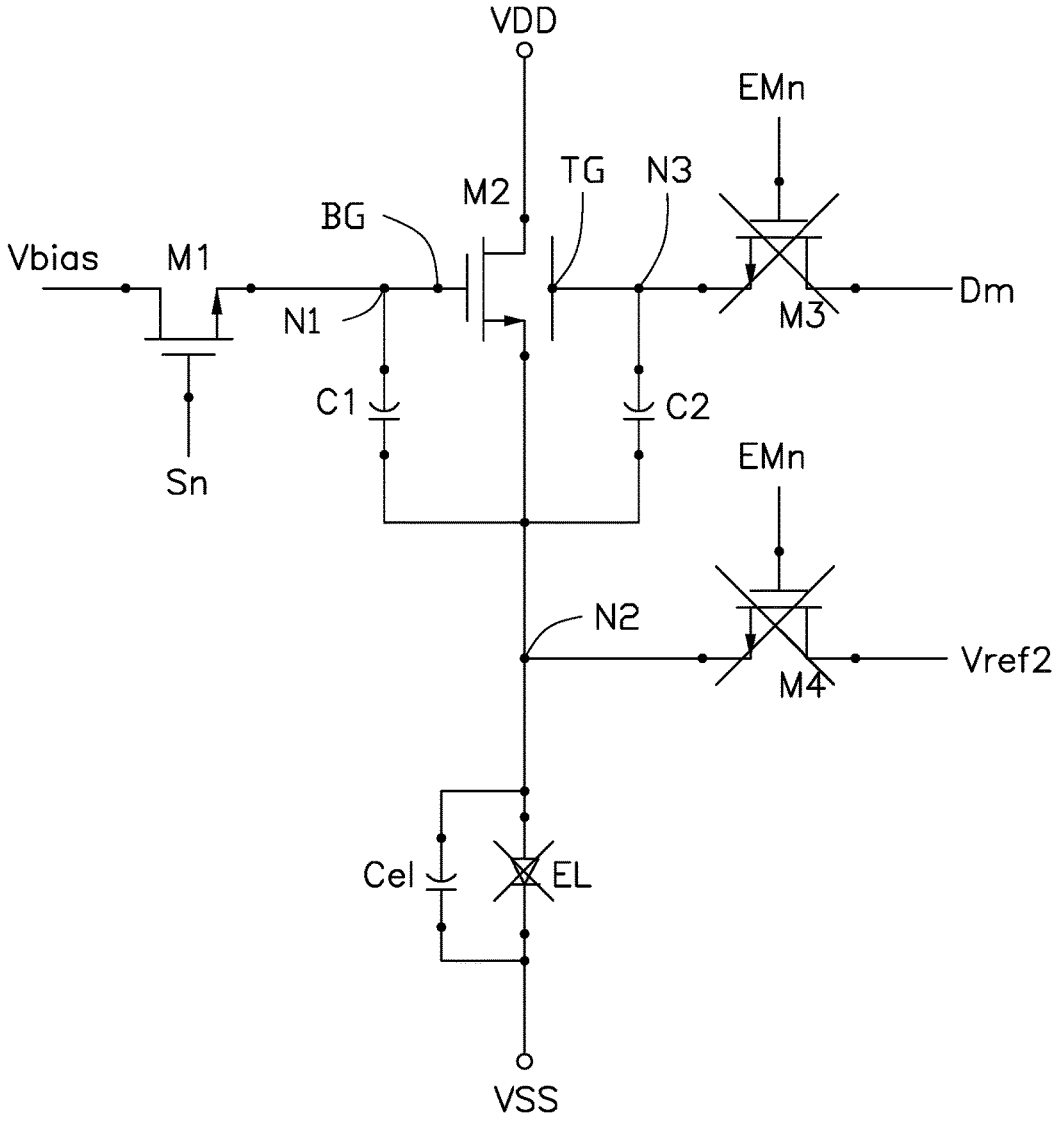
FIG. 6 is a circuit diagram view of the pixel driving circuit of FIG. 2, which operates in the compensation period, and the elements with a "X" mark are turned off.
Figure 7:
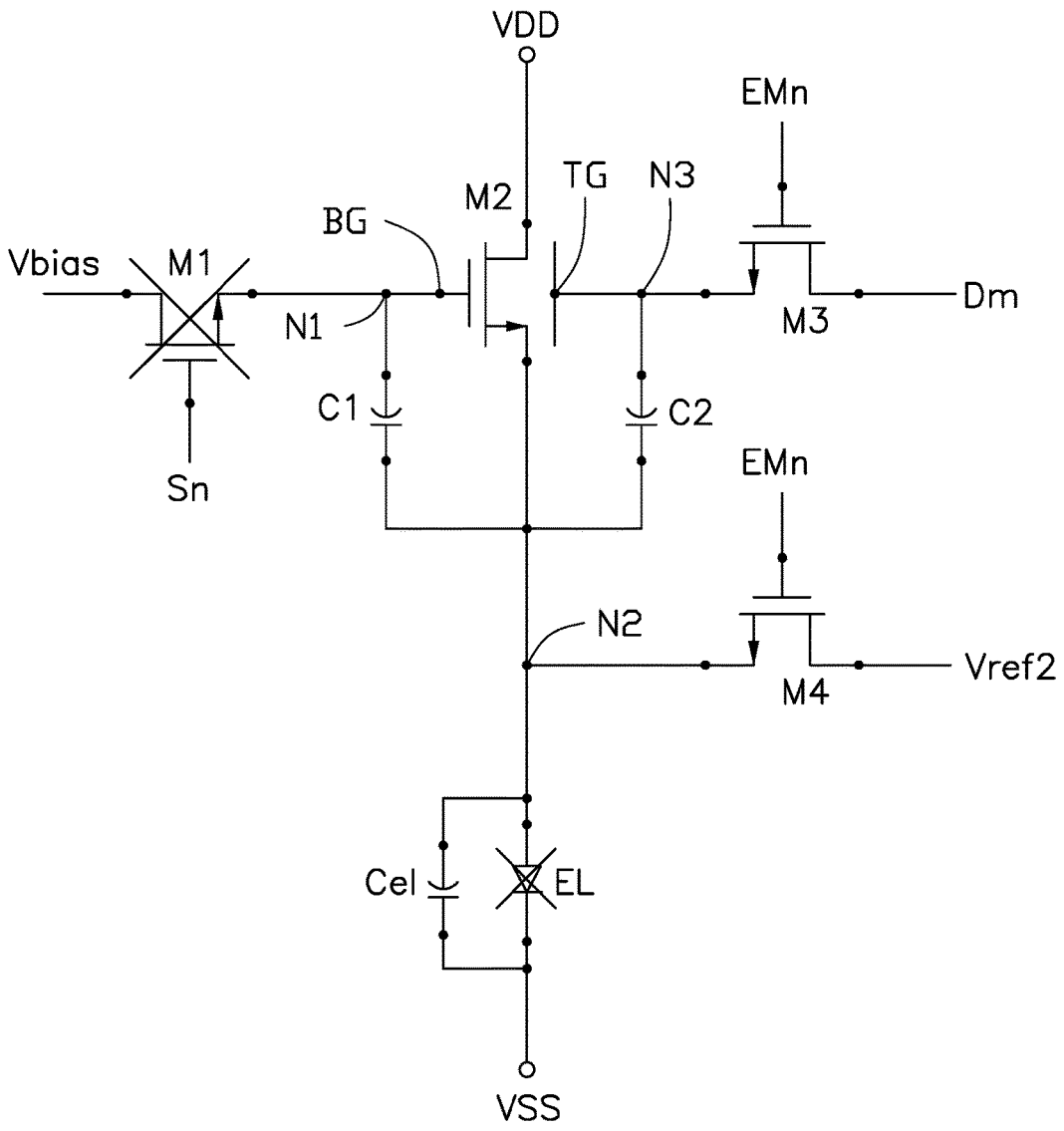
FIG. 7 is a circuit diagram view of the pixel driving circuit of FIG. 2, which operates in the writing period, and the elements with a "X" mark are turned-off.
Figure 8:
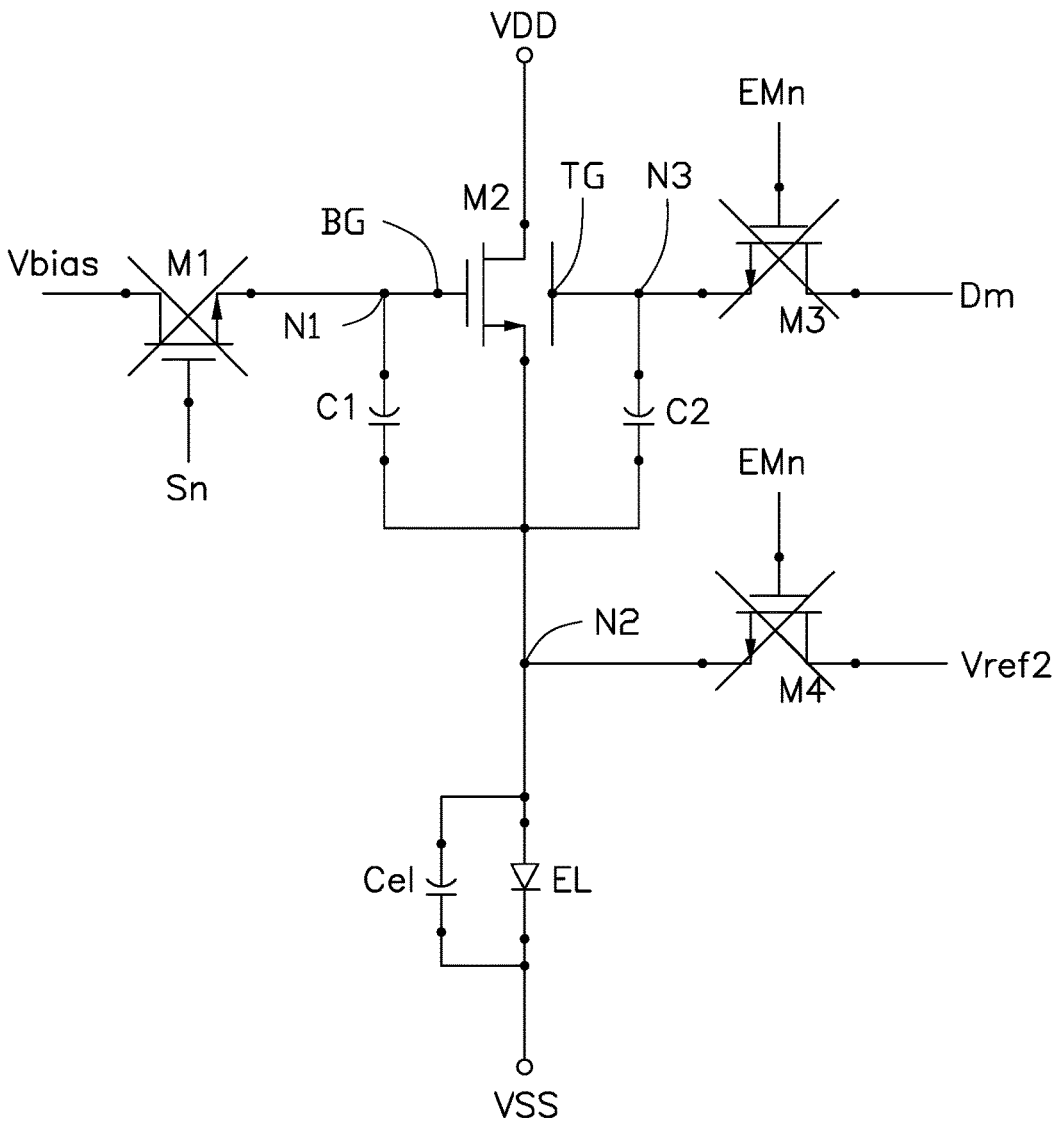
FIG. 8 is a circuit diagram view of the pixel driving circuit of FIG. 2, which operates in the emitting period, and the elements with a "X" mark are turned-off.

Referring to FIGS. 4 and 5, during the first frame f1, the pixel driving circuit 300 sets the first gate electrode BG of the drive transistor M2 at the bias voltage Vbias and the anode of the light emitting element EL, and further stores the first threshold voltage of the drive transistor M2 on the first storage capacitor C1. During the first frame f1, the pixel driving circuits 300 sequentially operate under the initiating period T1 and compensation period T2, the data line Dm provides a first reference voltage Vref1. During each of the other frames f2-fn, the pixel driving circuits 300 sequentially operate under the writing period T3 and the emitting period T4, the data line Dm provides a data voltage Vdata. In the embodiment, the data voltage Vdata is larger than the first reference voltage Vref1. The operation of one of the pixel driving circuit 300 is described as below.

When the signal on the connected scan line Sn and the control signal of the control line EMn are effective, the pixel driving circuit 300 is in the initiating period T1. During the initiating period T1, the initial transistor M1, the drive transistor M2, the control transistor M3, and the resetting transistor M4 turn on. The bias voltage is provided to the first gate electrode BG of the drive transistor M2 due to the initial transistor M1 being turned on, and the first storage capacitor C1 charges. The first reference voltage Vref1 is provided to the second gate electrode TG of the drive transistor M2 through the third node N3 due to the control transistor M3 being turned on. The second reference voltage Vref2 is provided to the second node N2 due to the resetting transistor M4 being turned on, thus the source electrode of the drive transistor M2 is being reset. The voltage stored on the second storage capacitor C2 is equal to a difference between the first reference voltage Vref1 and the second reference voltage Vref2. Thus, the light emitting element EL stops emitting light.

When the signal on the connected scan line Sn is effective, and the control signal of the control line EMn is ineffective, the pixel driving circuit 300 is in the compensation period T2. During the compensation period T2, the initial transistor M1 and the drive transistor M2 turn on, and the control transistor M3 and the resetting transistor M4 turn off. The voltage of the first gate electrode BG remains in the bias voltage due to the initial transistor M1 being turned on. The potential of the second node N2 is changed to a difference between the bias voltage Vbias and the first threshold voltage Vth1. Due to keep the potential stored on the second storage capacitor C2 to be constant, the potential of the third node N3 is changed to Vbias−Vth1+Vref1−Vref2. The light emitting element EL remains the non-luminous state.

When the signal on the connected scan line Sn is ineffective, and the control signal of the control line EMn is effective, the pixel driving circuit 300 is in the writing period T3. During the writing period T3, the initial transistor M1 turns off, the drive transistor M2, the control transistor M3, and the resetting transistor M4 turn on. The potential of the second node N2 is equal to the second reference voltage Vref2 due to the resetting transistor M4 being turned on. Due to keep the potential stored on the first storage capacitor C1, the potential of the first node N1 is changed to Vbias−(Vbais−Vth1)+Vref2, which is equal to Vth1+Vref2. The data voltage Vdata on the data line Dm is provided to the second gate electrode TG of the drive transistor M2 due to the control transistor M3 being turned on, and the second storage capacitor C2 further charges. The potential stored on the second storage capacitor C2 is equal to a difference between the data voltage Vdata and the second reference voltage Vref2.

When the signal on the connected scan line Sn and the control signal of the control line EMn are ineffective, the pixel driving circuit 300 is in the emitting period T4. During the emitting period T4, the initial transistor M1, the control transistor M3, and the resetting transistor M4 turn off, and the drive transistor M2 turn on. The potential of the second node N2 is changed to the emitting voltage Voled. Due to keep the potential stored on the first storage capacitor C1, the potential of the first node N1 is changed to Vbias−(Vbais−Vth1)+Voled, which is equal to Vth1+Voled. Due to keep the potential stored on the second storage capacitor C2, the potential of the third node N3 is changed to Vdata−Vref2+Voled.

The current provided to the light emitting element EL is calculated by the formula.

$$1)\quad Ioled = k \times (Vgs - Vth)^2 = k \times [Vth1 + Voled - Voled - Vth2]^2 = k \times [(Vth1 - Vth2)]^2$$

K represents a current amplified constant value related to the carrier mobility and a ratio between a width to a length of a channel of the drive transistor M2. Vth1 represents the first threshold voltage of the drive transistor M2 in the first frame f1. Vth2 represents the second threshold voltage of the drive transistor M2 in the other frames f2-fn, and is related to the data voltage Vdata.

Figure 9:
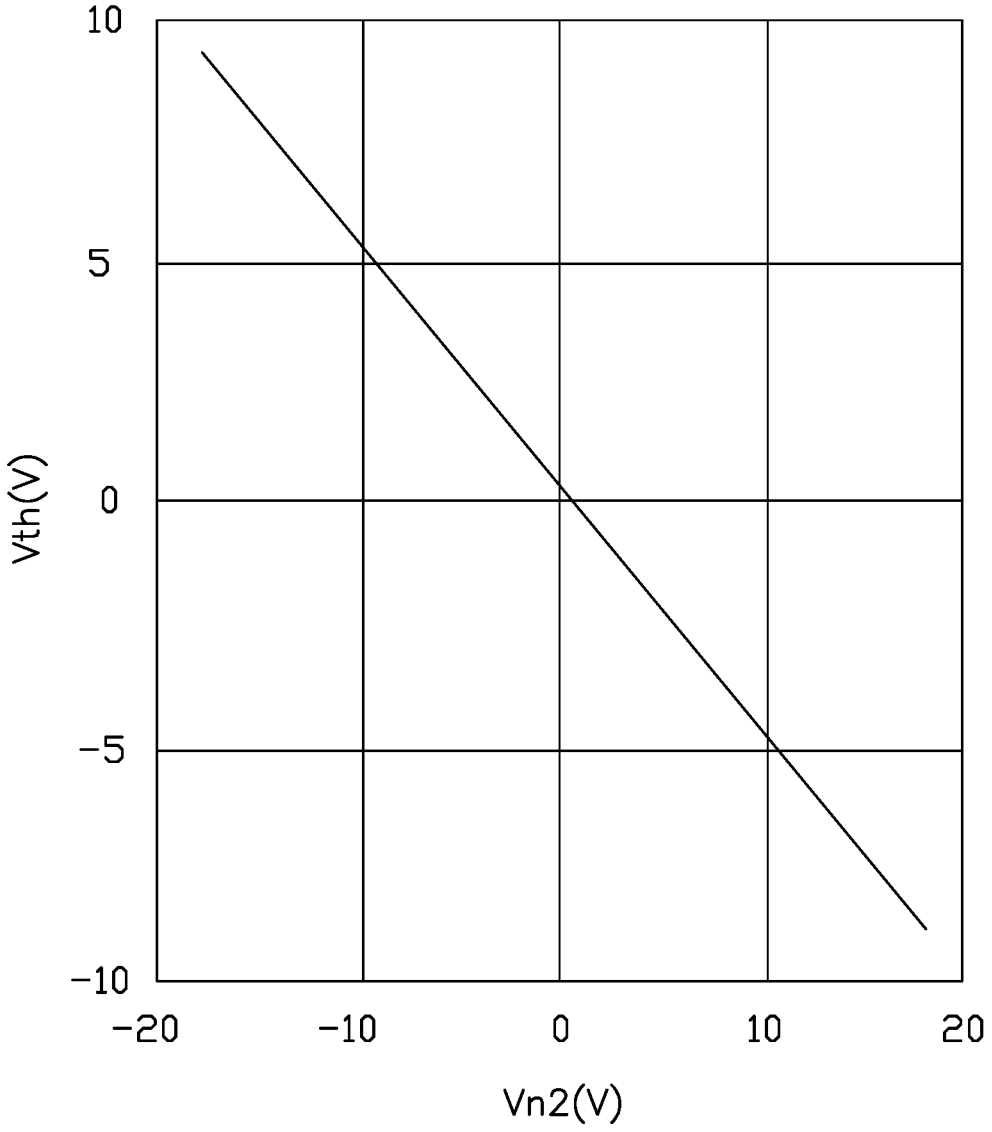
FIG. 9 is a diagram view of the voltage on the top gate electrode and a threshold voltage of the drive transistor.

FIG. 9 illustrates the relation of the threshold voltage of the drive transistor M2 and the voltage provided on the second gate electrode TG of the drive transistor. The threshold voltage of the drive transistor M2 is linearly varied in accordance with a voltage of the second gate electrode TG of the drive transistor M2, and the relationship is calculated by the formula below.

$$Vth = a(Vn2 - Vn3) + b \qquad 2)$$

Vn2 represents a potential of the second node N2. Vn3 represents a potential of the third node N3. Both a and b in the formula 2) represent a constant value.

The first threshold voltage Vth1 of the drive transistor M2 in the first frame f1 is related to the first reference voltage Vref1, which can be calculated by the formula 2).

$$Vth1 = a(Vn2 - Vn3) + b = a(Vref1 - Vref2) + b$$

The second threshold voltage of the drive transistor M2 in the other frames f2-fn is related to the data voltage Vdata, which can be calculated by the formula 2).

$$Vth2 = a(Vn2 - Vn3) + b = a(Vdata - Vref2) + b = a(Vref1 + \Delta V - Vref2) + b$$

ΔV represents a difference voltage between the first reference voltage Vref1 and the data voltage Vdata, which is a constant value.

Thus, the current of the light emitting element EL can be further represents as below.

$$\begin{aligned} Ioled &= k \times [(Vth1 - Vth2)]^2 \\ &= k \times \{(a(Vref1 - Vref2) + b - [a(Vref1 + \Delta V - Vref2) + b]\}^2 \\ &= k \times a^2 (Vref2 - \Delta V)^2 \end{aligned}$$

As the above recited, the current on the light emitting element EL only relates with the second reference voltage Vref2 and a difference voltage of the first reference voltage Vref1 and the data voltage Vdata, and has no relationship with the threshold voltage of the drive transistor M2.

Based on the structure of the display apparatus 1 with pixel driving circuit 300, during the first frame, the pixel driving circuit 300 only operates under the initiating period T1 and the compensation period T2, which prevents the current of the light emitting element of the display apparatus 1 being effect by a difference of the threshold voltage of the drive transistor M2, thus a display performance of the display apparatus 1 is improved. The drive transistor M2 with two gate electrodes can reduces an area of the pixel driving circuit 300, which is suitable for a narrow border display apparatus 1. A uniformity and brightness of the display apparatus 1 is improved by the current type pixel driving circuit 300.

Figure 10:
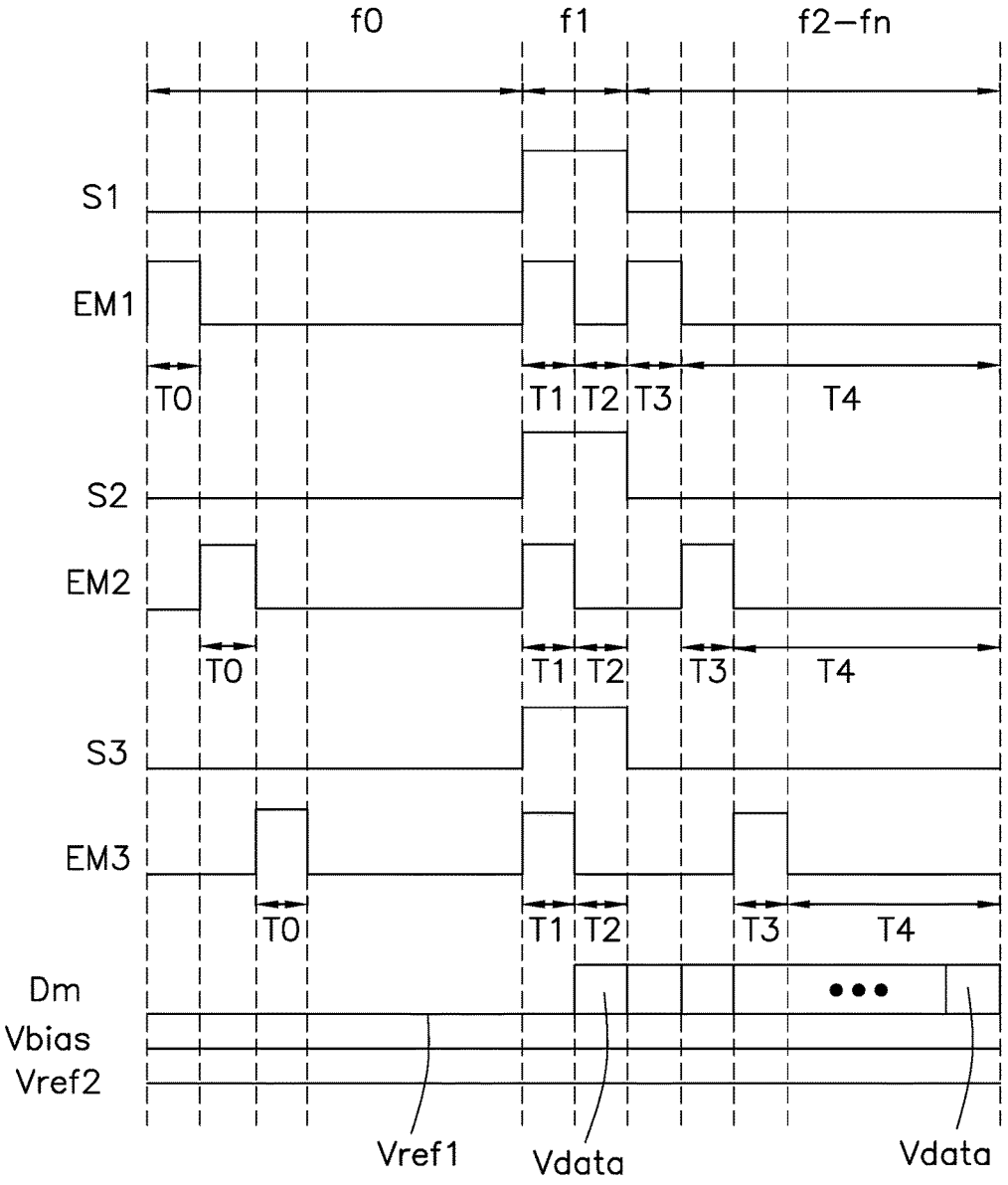
FIG. 10 is a timing chart showing waveforms of a second embodiment of various signals of the pixel units of FIG. 1.

FIG. 10 illustrates a second embodiment of waveforms of the various signals of the pixel units 10 operated in different frames. FIG. 10 only shows the waveforms of the various signals of the pixel units 10 corresponding to the scan lines S1-S3. The display apparatus 1 further includes a blanking frame f0. During the blanking frame f0, the pixel driving circuit 300 resets the source electrode of the drive transistor M2. During the first frame f1, the anode of the light emitting element EL is reset. During the blanking frame f0, the pixel driving circuits 300 sequentially operates under the reset period T0. During the blanking frame f0, the signals of the scan lines S1-Sn are ineffective, and the control signals are effective. During the first frame f1, all of the pixel driving circuits 300 simultaneously operate under an initiating period T1, and then further simultaneously operate under a compensation period T2 when all of the pixel driving circuits 300 being initial. During the first frame f1, each data line Dm provides the first reference voltage Vref1. During the other frames f2-fn, the pixel driving circuits 300 simultaneously operate under a writing period T3. Each pixel driving circuit 300 operates under an emitting period T4 after the writing period. During the other frames f2-fn, each data line Dm provides a data voltage Vdata.

Based on the structure of the display apparatus 1 with the pixel driving circuit 300, during the blanking frame, the pixel driving circuit 300 resets the drive transistor M2. During the first frame, the pixel driving circuit 300 only operates under the initiating period T1 and the compensation period T2, which prevents the current of the light emitting element of the display apparatus 1 being effect by a difference of the drive transistor M2, thus a display performance of the display apparatus 1 is improved. Further, the pixel driving circuits 300 simultaneously operates in the initiating period T1, and then simultaneously operates in the compensation period T2. The drive transistor M2 with two gate electrodes can reduces an area of the pixel driving circuit 300, which is suitable for a narrow border display apparatus 1. A uniformity and brightness of the display apparatus 1 is improved by the current type pixel driving circuit 300.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including matters of shape, size, and arrangement of the parts within the principles of the present disclosure, up to and including the full extent established by the broad general meaning of the terms used in the claims.

What is claimed is:

1. A pixel driving circuit for driving a pixel unit, the pixel driving circuit comprising:

a light emitting element;

a drive transistor with a first gate electrode and a second gate electrode, and configured to transmit a current to the light emitting element;

an initial transistor connected between a bias voltage line and the first gate electrode of the drive transistor and configured to receive a control signal of a scan line;

a control transistor electrically connected with a data line and configured to provide the voltage on the data line to the second gate electrode of the drive transistor due to a control signal of a control line;

a resetting transistor connected to a second reference voltage line and the source of the drive transistor and configured to reset the drive transistor based on the control signal;

a first storage capacitor, two terminals of which are electrically connected to the first gate electrode and a source electrode of the drive transistor respectively; and a second storage capacitor, two terminals of which are electrically connected to the second gate electrode and the source electrode of the drive transistor respectively;

wherein a gate electrode of the initial transistor is electrically connected to the scan line, a source electrode of the initial transistor is electrically connected to the bias voltage line, and a drain electrode of the initial transistor is electrically connected to the first gate electrode of the drive transistor; a gate electrode of the control transistor is electrically connected to the control line, a source electrode of the control transistor is electrically connected to the second gate electrode of the drive transistor, and a drain electrode of the control transistor is electrically connected to the data line; a gate electrode of the resetting transistor is electrically connected to the scan line, a source electrode of the resetting transistor is electrically connected to the second reference voltage line, and a drain electrode of the resetting transistor is electrically connected to the source electrode of the drive transistor;

wherein a data voltage of the data line is provided to the second gate electrode of the drive transistor through the control transistor;

wherein the pixel driving circuit sequentially operates under a first frame and other frames after the first frame; during the first frame, the pixel driving circuit sequentially operates under an initiating period and a compensation period;

wherein when the control signal of the scan line and the control signal are effective, the pixel driving circuit is in the initiating period; during the initiating period, the initial transistor, the control transistor, the resetting transistor, and the drive transistor are turned on; a bias voltage is provided to the first gate electrode, a first reference voltage on the data line is provided to the second gate electrode, and a second reference voltage is provided to the source electrode of the drive transistor.

2. The pixel driving circuit of claim 1, wherein a threshold voltage of the drive transistor is linearly varied in accordance with a voltage of the second gate electrode of the drive transistor.

3. The pixel driving circuit of claim 1, wherein when the control signal of the scan line is effective, and the control signal is ineffective, the pixel driving circuit is in the compensation period; during the compensation period, the initial transistor, and the drive transistor turn on; the control transistor and the resetting transistor turn off; a first threshold voltage of the driving voltage is stored on the first storage capacitor.

4. The pixel driving circuit of claim 1, wherein during the other frames, the pixel driving circuit sequentially operates under a writing period and an emitting period; when the control signal of the scan line is ineffective, the control signal is effective, the pixel driving circuit is in the writing period; during the writing period, the initial transistor turns off, the control transistor, the resetting transistor, and the drive transistor turn on; the data voltage of the data line is provided to the second gate electrode, the second storage capacitor stores a second threshold voltage and the data voltage.

5. The pixel driving circuit of claim 4, wherein when the control signal on the scan line and the control signal are effective, the pixel driving circuit is in the emitting period; during the emitting period, the initial transistor, the control transistor, and the resetting transistor turn off, the drive transistor turns on for driving the light emitting element based on the data voltage of the data line.

6. A display apparatus comprising:

a plurality of scan lines;

a plurality of data lines;

a plurality of control lines;

a plurality of pixel units, each of which corresponds to one of the plurality of scan lines, one of the plurality of data lines, and two adjacent of the plurality of control lines;

a plurality of pixel driving circuits corresponding to the plurality of pixel units respectively, and each of the plurality of pixel driving circuit further comprising:

a light emitting element;

a drive transistor with a first gate electrode and a second gate electrode, and configured to transmit a current to the light emitting element;

an initial transistor connected between a bias voltage line and the first gate electrode of the drive transistor and configured to receive a control signal of a scan line;

a control transistor electrically connected with a data line and configured to provide the voltage on the data line to the second gate electrode of the drive transistor due to a control signal of a control line;

a resetting transistor connected to a second reference voltage line and the source of the drive transistor and configured to reset the drive transistor based on the control signal;

a first storage capacitor, two terminals of which are electrically connected to the first gate electrode and a source electrode of the drive transistor respectively; and a second storage capacitor, two terminals of which are electrically connected to the second gate electrode and the source electrode of the drive transistor respectively;

wherein a gate electrode of the initial transistor is electrically connected to the scan line, a source electrode of the initial transistor is electrically connected to the bias voltage line, and a drain electrode of the initial transistor is electrically connected to the first gate electrode of the drive transistor; a gate electrode of the control transistor is electrically connected to the control line, a source electrode of the control transistor is electrically connected to the second gate electrode of the drive transistor, and a drain electrode of the control transistor is electrically connected to the data line; a gate electrode of the resetting transistor is electrically connected to the scan line, a source electrode of the resetting transistor is electrically connected to the second reference voltage line, and a drain electrode of the resetting transistor is electrically connected to the source electrode of the drive transistor;

wherein a data voltage of the data line is provided to the second gate electrode of the drive transistor through the control transistor;

wherein the display apparatus sequentially operates under a first frame and other frames after the first frame; during the first frame, the pixel driving circuits sequentially operate under an initiating period, and then sequentially operate under a compensation period when all of the pixel driving circuits are initialized; during the other frames, the pixel driving circuits sequentially operate under a writing period; each pixel driving circuit operates under an emitting period after the writing period;

wherein when the control signal of the corresponding scan line and the control signal are effective the pixel driving circuit is in the initiation period; during the initiation period, the initial transistor, the control transistor, the resetting transistor, and the drive transistor are turned on; a bias voltage is provided to the first gate electrode, a first reference voltage on the data line is provided to the second gate electrode, and a second reference voltage is provided to the source electrode of the drive transistor.

7. The display apparatus of claim 6, wherein when the control signal of the scan line is effective, and the control signal is ineffective, the pixel driving circuit is in the compensation period; during the compensation period, the initial transistor and the drive transistor turn on; the control transistor and the resetting transistor turn off; the first threshold voltage of the driving voltage is stored on the first storage capacitor.

8. The display apparatus of claim 6, wherein during the writing period, the data voltage of the data line is provided to the second gate electrode, the second storage capacitor stores a second threshold voltage and the data voltage; during the emitting period, the light emitting element emits light based on the data voltage, the data voltage is larger than the first reference voltage.

* * * * *